United States Patent [19]

Yang

[11] 4,298,565

[45] Nov. 3, 1981

[54] SPINNING PROCESS

[75] Inventor: Hung H. Yang, Richmond, Va.

[73] Assignee: E. I. Du Pont de Nemours and Company, Wilmington, Del.

[21] Appl. No.: 120,888

[22] Filed: Feb. 12, 1980

[51] Int. Cl.[3] ..... D01D 5/14

[52] U.S. Cl. ..... 264/181; 264/184; 264/210.3; 425/70

[58] Field of Search ..... 264/180, 181, 184, 210.3; 425/68–71

[56] References Cited

U.S. PATENT DOCUMENTS

| | | | |
|---|---|---|---|
| 2,437,263 | 3/1948 | Manning | 264/181 |
| 2,510,135 | 6/1950 | Pedlow et al. | 264/180 |
| 3,689,620 | 9/1972 | Miyazaki et al. | 264/181 |
| 3,833,438 | 9/1974 | Kaneko et al. | 264/181 |
| 3,996,321 | 12/1976 | Weinberger | 264/184 |
| 4,070,431 | 1/1978 | Lewis et al. | 264/184 |
| 4,078,034 | 3/1978 | Lewis | 264/184 |

FOREIGN PATENT DOCUMENTS

| | | | |
|---|---|---|---|
| 1934541 | 1/1971 | Fed. Rep. of Germany | 264/210.8 |
| 2145706 | 10/1972 | Fed. Rep. of Germany . | |
| 53-42802 | 11/1978 | Japan | 264/181 |

*Primary Examiner*—Jay H. Woo

[57] ABSTRACT

A process for preparing high strength, high modulus aromatic polyamide filaments by extruding an acid solution containing at least 30 g. per 100 acid of an aromatic polyamide having an inherent viscosity of at least 4 and chain extending bonds which are either coaxial or parallel and oppositely directed through a layer of inert noncoagulating fluid into a coagulating bath and then through a spin tube along with overflowing coagulating liquid is improved by jetting additional coagulating liquid symmetrically about the filaments in a downward direction forming an angle $\theta$ or 0° to 85° with respect to the filaments within 2.0 milliseconds from the time the filaments enter the spin tube, the flow rates of both the jetted and overflowing coagulating liquid being maintained at a constant rate such that their momentum ratio $\phi$ is from 0.5 to 6.0 and the mass flow rate of total coagulating liquid is from 70 to 200 times the mass flow rate of the filaments.

8 Claims, 4 Drawing Figures

FIG. 2a
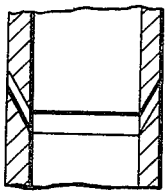
FIG. 2b
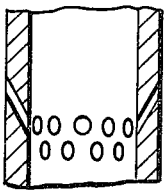
FIG. 2c
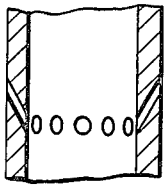
FIG. 2d
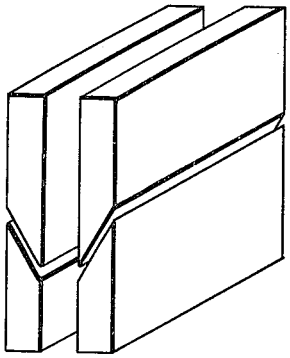
FIG. 2e
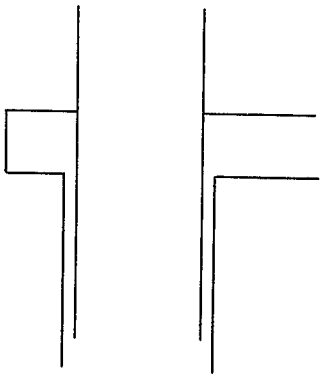
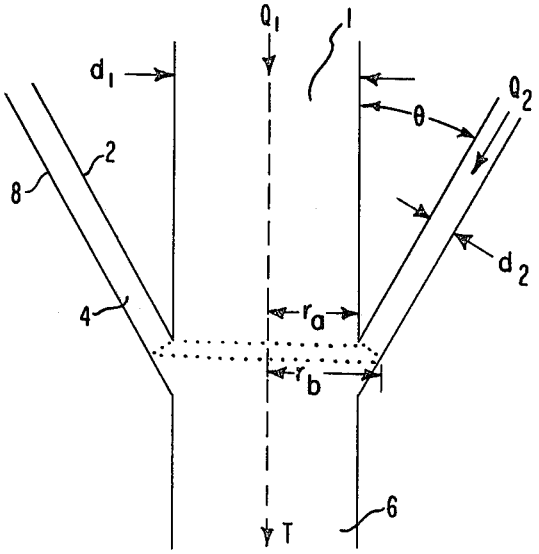
FIG. 3

SPINNING PROCESS

This invention relates to an improved process for spinning high strength, high modulus aromatic polyamide filaments at commercially attractive spinning speeds.

BACKGROUND OF THE INVENTION

A process for preparing high strength, high modulus aromatic polyamide filaments is known from U.S. Pat. No. 3,767,756 whereby highly anisotropic acid solutions of aromatic polyamides whose chain extending bonds are either coaxial or parallel and oppositely directed are extruded through a spinneret into a layer of inert noncoagulating fluid into a coagulating bath and then along with overflowing coagulant through a vertical spin tube aligned with the spinneret. Improved results are obtained if the entrance of the spin tube is provided with a deflecting ring as described in U.S. Pat. No. 4,078,034.

This process provides high strength, high modulus filaments of aromatic polyamides such as poly(p-phenylene terephthalamide) which are useful in the construction of vehicle tires, industrial belts, ropes, cables, ballistic vests, protective clothing and other uses.

Efforts to increase spinning speeds beyond about 500 yards per minute cause a reduction in fiber strength, particularly when the denier of the yarn spun is of the order of 1500 denier or more.

This invention provides an improvement over the spinning processes of U.S. Pat. Nos. 3,767,756 and 4,078,034 whereby the tenacity of the resulting filaments and yarn is increased, usually by a desirably significant amount of at least 1 g./denier (0.88 dN/tex) at a given spinning speed greater than 250 m/min. The yarns produced also have an incremently improved retention of tenacity both when aged at high temperature and when converted to plied cords. In general, the magnitude of the improvements increases with the speed at which the extruded yarn is withdrawn from the spin tube.

BRIEF DESCRIPTION OF THE INVENTION

This invention provides an improved process for preparing high strength, high modulus aromatic polyamide filaments whereby an acid solution containing at least 30 g./100 ml. acid of an aromatic polyamide whose chains extending bonds are either coaxial or parallel and oppositely directed having an inherent viscosity of at least 4 is extruded through a spinneret into a layer of inert noncoagulating fluid into a coagulating bath to form filaments, which along with overflowing coagulating liquid, are passed through a spin tube aligned with the spinneret, wherein within two milliseconds of entrance of the filaments into the spin tube additional coagulating liquid is jetted symmetrically about the filaments along a downward direction forming an angle $\theta$ of 0° to 85° with respect to the filaments, the flow rates of both the jetted and overflowing coagulating liquid being maintained constant such that their momentum ratio $\phi$ is from 0.5 to 6.0 and the mass flow rate of total coagulating liquid is from 70 to 200 times the mass flow rate of the filaments. The filaments and coagulating liquid may be unconfined below the point where the jetting liquid is introduced or they may be confined in an extension of the spin tube having the same cross-sectional shape as the spin tube with a minor cross-sectional dimension of from 0.5 to 1.5 times that of the spin tube and a length/minor dimension ratio of 0.5 to 10. Preferably the jetted liquid is applied within 1 millisecond of entry into the spin tube. Preferably, the filaments are wound up at a speed of at least 500 yds./min., more preferably at least 650 yds./min. and most preferably at least 750 yds./min. $\theta$ is preferably 30° to 45°. Preferably $\phi$ is 1.5 to 4 and the mass flow rate of the total coagulating liquid is preferably 80 to 120 times that of the filaments. If the filaments and coagulating liquid are confined in an extension of the spin tube, preferably the extension has the same cross-sectional dimension as the spin tube and a length/minor dimension ratio of about 5. The required dimension of the spin tube can be readily calculated from $\phi$ and the mass flow ratio.

FIGS. *2a–e* illustrate various jet configurations suitable for carrying out the process of the present invention.

FIG. 3 represents a typical apparatus arrangement for illustrating the calculation of $\phi$.

Figure 4:
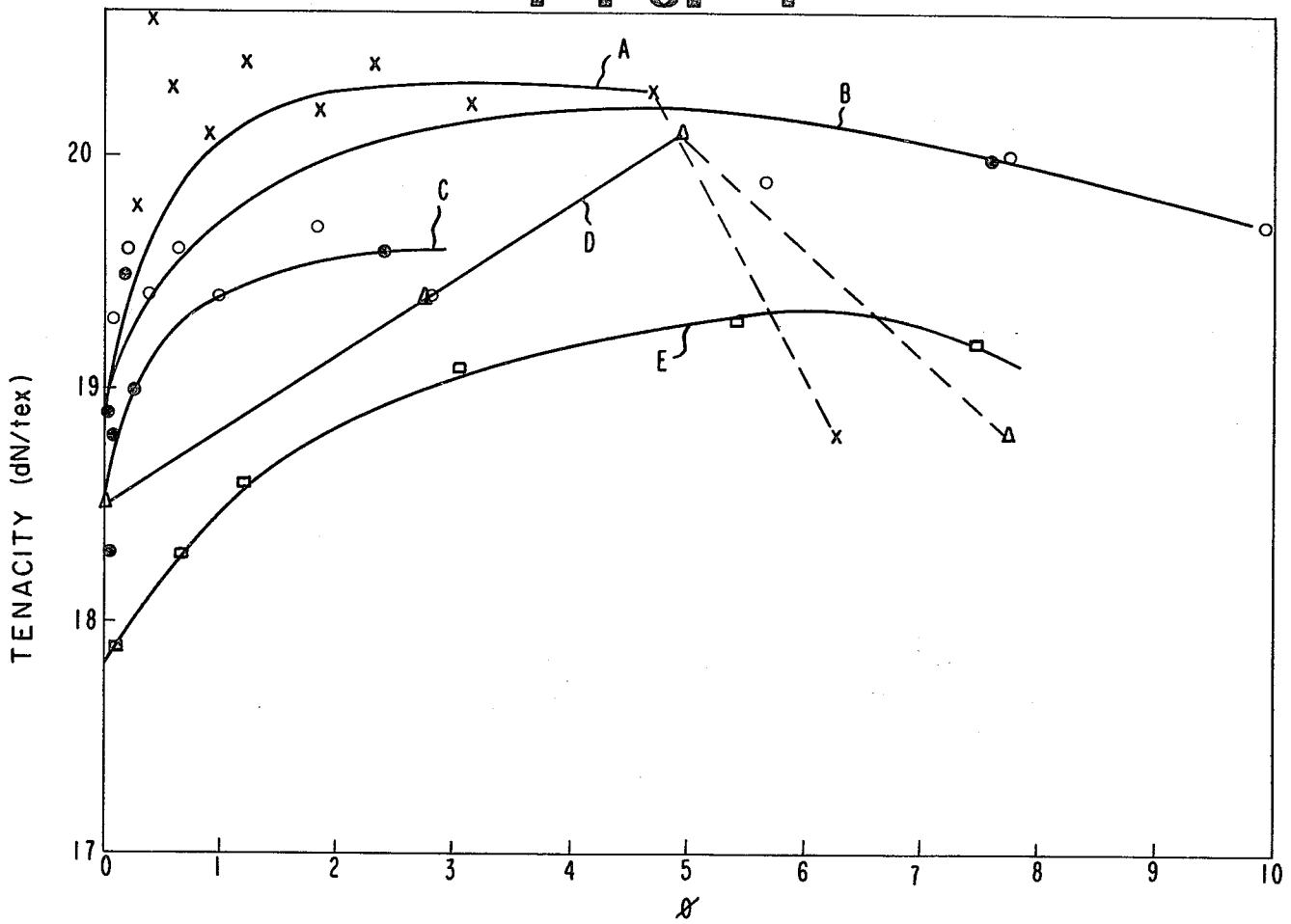

FIG. 4 is a plot of tenacity versus $\phi$ for Example IX of the application.

DETAILED DESCRIPTION

The process of this invention is effective to promote increased tenacity for all para-oriented aromatic polyamide yarns, but usually linear densities are from 30 to 4500 denier (33 to 5000 dtex) and preferably are 200 to 3000 denier (222 to 3333 dtex), and linear densities of single filaments are usually from 0.5 to 3.0 denier (0.56 to 3.33 dtex) and preferably are 1.0 to 2.25 denier (1.1 to 2.5 dtex).

The minor cross-sectional dimension of the jets (e.g., hole diameters or slot-widths) are generally in the range of 2 to 100 mils (0.05 to 2.5 mm), preferably in the range 5 to 20 mils (0.13 to 0.51 mm). Likewise, the velocity of jetted coagulating liquid may be as much as 150% that of the yarn being processed, but it preferably does not exceed about 85% of the yarn velocity.

Two mechanisms have been observed which are believed responsible for the improved tensile properties obtained using the process of the invention. First, the threadline tension below the extension of the spin tube is desirably reduced; and, secondly, an expansion of the threadline occurs whereby the coagulating liquid more effectively quenches and extracts solvent components from the advancing threadline. These effects are correlatable with $\phi$ (momentum ratio) as defined hereinafter. A minimum $\phi$ of about 0.5 is required for obtaining statistically significant improvements.

The optimum value of $\phi$ is not a constant but rather depends generally on linear density and spinning speed of the yarn being processed, lower values of linear density and speed corresponding to lower $\phi$ values within the useful range, and vice versa. Moreover, improvements are not observed unless the spinneret, spin tube, jets, and extension of the spin tube are carefully aligned on the same axis and unless the jet elements are carefully designed and aligned to provide perfectly symmetrical jetting about the threadline. Any misalignment of jet elements or the lodging of any solid particles in jet openings so as to destroy perfect symmetry will reduce or eliminate the improvements. Such symmetry may be provided from two or more jet orifices, or from slots symmetrically spaced with respect to the threadline(s).

Typical operation of the process of this invention is described with reference to FIG. 1 which is a vertical cross-section of apparatus 10 through threadline path T as an axis of symmetry. Except for ports for liquid input, all elements shown are circularly symmetrical and would appear the same in any similar cross-section. Sidewalls 12 and bottom 14 form a cylindrical container for coagulating liquid which also has a partial top comprising lips 16. A partial internal imperforate wall 18 extends most of the distance from bottom 14 to lip 16, the remaining distance being completed with screening 20, or the like. A plenum 22 is formed by internal partition 24 having multiple orifices 26 for liquid flow. Inserted axially in the apparatus 10 is the assembly 30 which is mounted in retaining elements 32 so as to permit vertical adjustment. Structurally it includes an outer shell 34 and an inner shell 36 spaced to provide a passage 38 for coagulating liquid which is metered into passage 38 through inlet port 40. At the top of assembly 30, spin tube 42 is provided through the outer wall. Insert 44 includes an extension 46 of spin tube 42, and the opposing faces at the base of spin tube 42 and top of extension 46 are machined and spaced to provide a circularly symmetrical slot jet 48.

In operation, coagulating liquid is fed through an external port (not shown) into manifold 22, through holes 26, up to lips 16, and through flow-directing screening 20 until apparatus 10 is full of coagulating liquid to a fixed level 50 maintained by minimal overflow of liquid over lips 16 to a collection area (not shown). Due to the elevation h of level 50 above the entrance to spin tube 42, coagulating liquid overflows downward through spin tube 42 at a rate determined by the vertical adjustment of assembly 30. At the same time, additional coagulating liquid is metered through port 40 into the channel between shells 34 and 36, and out through jets 48 into the stream of coagulating liquid overflowing into spin tube 42.

The whole apparatus 10 is carefully aligned axially with threadline path T for filaments (not shown, for clarity) being extruded through spinneret 52. An air gap 54 separates spinneret 52 from the surface 50 of coagulating liquid. Screens 20 produce substantially horizontal flow of coagulating liquid which, coupled with a sufficiently large diameter of inner walls 18, results in the requisite quiescence of surface 50.

Flow-rate $Q_2$ of jetted coagulating liquid is controlled by metered pumping. Flow-rate $Q_1$ of coagulating fluid is controlled by adjustment of dimension h by metering but also depends on the diameter of spin tube 42. Dimension h is ordinarily less than one inch (2.5 cm) and preferably about 0.5 inch (1.3 cm). If it is too small, air will be drawn into spin tube 42 by the pumping action of the advancing filaments, and such as deleterious to both tensile properties and mechanical quality of the yarn produced. Thus, h must be great enough to assure no entrainment of gas bubbles. As specified above, $Q_1$ and $Q_2$ must be adjusted to provide a momentum ratio $\phi$ within a given range and also a ratio (R) of weight of coagulating liquid to filament weight within a given range. The above considerations lead to ready calculation of a suitable diameter of spin tube 42.

FIG. 2 shows diagrammatically some suitable types of symmetrical jet configurations which can be used. While the spin tube and its extension when present need not have identical minimum cross-sectional dimensions (i.e., diameters for FIGS. 2*a*, 2*b*, 2*c*, and 2*e* and separations for FIG. 2*d*), they are shown equal in FIG. 2. FIG. 2*a* represents a single continuous slot-type jet as just described. FIG. 2*c* illustrates a single row of cylindrical-hole jets, and FIG. 2*b* shows that multiple rows of holes can be used as long as symmetry of flow is maintained. FIG. 2*d* illustrates a linear jet arrangement for handling a linear, rather than circular, array of filaments. Finally, FIG. 2*e* shows schematically an arrangement for providing a $\theta$ of zero (see FIG. 3). A multitude of suitable symmetrical jet arrangements is suggested by this Figure.

The process of this invention is one that permits the producer to supply filaments of incrementally improved properties. Thus, it is most important from a commercial standpoint. Because the improvements are incremental in nature, it is easy for any given experiment to provide results not supporting an improvement since alignment of apparatus elements, symmetrical jetting, and the exclusion of particles capable of interfering with symmetrical operation of an otherwise symmetrical jet are so critical to optimum results. Such precautions are relatively easily taken in a commercial process but are difficult to control precisely in laboratory experiments involving repeated readjustments. Thus, it is normally necessary to carry out several experimental tests before the magnitude of a given improvement can be specified with certainty.

Regarding the requirement that $\theta$ be in the range 0 to 85 degrees, it is pointed out that satisfactory results are also obtainable for $\theta=90$ degrees. This selection of $\theta$, however, makes the process very critical to control and is, therefore, not as desirable in commercial operation.

Use of supplemental jetting reduces the tension required for forwarding the filaments at a given speed subsequent to jetting, and this reduction in tension is believed to be at least partially responsible for the improved tenacity. If $Q_1$ and $Q_2$ are adjusted to provide optimum tenacity, it is logical to assess the effects of jetting by reducing $Q_2$ in steps until $Q_2$=zero. A diminishment in tenacity usually results, but tension at $Q_2=0$ is often precipitously reduced, as well as yarn quality. This is misleading, however, because $Q_1$ has been kept constant. The $Q_1$ which is optimum when $Q_2 \neq 0$ and 0 is in the effective range is too low for optimum results when $Q_2=0$. Thus, the significantly reduced tension frequently observed is due to entrainment of gas in the spin tube due to h being too small (FIG. 1).

The most valid comparison of results for tests with and without the supplemental jetting of this invention involves optimized settings of the various flow parameters for each polymer solution and filament-forwaring speed. When this is done, essentially all variables are varied. The following examples assemble experimental results in a fashion to show the various improvements and the scope of the invention most effectively. As alluded to earlier, very many tests were performed in confirming the improvements of the invention and, for reasons mentioned, not all of them consistently showed the improvements. Analysis of all the results, however, confirmed that the process of this invention always increases attainable tenacity and essentially always by at least 1 gm/den (0.88 dN/tex).

TEST PROCEDURES

Yarn properties are measured at 24° C. and 55% relative humidity on yarns which have been conditioned under the test conditions for a minimum of 14 hours. Before test, each yarn is twisted to a 1.1 twist multiplier (e.g., nominal 1500 denier [1670 dtex] yarn is given a twist of about 0.8 turn/cm). Tenacity is measured on 25.4 cm lengths at 50% strain/minute. Linear densities are calculated from weights of known lengths of yarn corrected to a finish-free basis contained 4.5% moisture.

Inherent viscosity ($\eta$inh) at 30° C. is computed from:

$$\eta inh = 1n(t_1/t_2)/c$$

where $t_1$=solution flow time in the viscometer, $t_2$=solvent flow time in the viscometer c=polymer concentration of 0.5 gm/dL and the solvent is 96% $H_2SO_4$. For determining $\eta$inh of yarn, the "polymer" is a section of yarn.

SPINNING SOLUTIONS

In the following examples, the spinning solutions are 19.4±0.1% (by weight) poly(p-phenyleneterephthalamide) in 100.1% $H_2SO_4$ as solvent.

SPINNING

The spinning solution at 75° to 80° C. is extruded through a spinneret. The extruded filaments pass first through an air gap of 0.25 inch (0.64 cm) and then through a coagulating liquid (see FIG. 1) maintained at 2° to 5° C. and consisting of water containing 3 to 4% by weight $H_2SO_4$. After washing, neutralizing, and drying the yarn, it is wound at a speed (defined as "yarn-speed" hereafter) which is substantially identical to yarn-speed at a "change-of-direction" guide positioned below the apparatus of FIG. 1.

For most examples the spinneret employed has 1000 orifices 2.5 mils (0.064 mm) in diameter equally spaced in rows within a circle 1.7 in (4.3 cm) in diameter. When different numbers of filaments were spun, the diameter of the circle of orifices was varied to provide substantially equal orifice size and spacing.

MOMENTUM RATIO ($\phi$)

The momentum ratio is defined as the ratio of momentum ($M_2$) along the threadline direction for jetted coagulating liquid to momentum ($M_1$) of the overflowing coagulating liquid; i.e., $\phi = M_2/M_1$. Momentum is defined as the product of the mass-rate and the velocity of flow. For both jetted and overflowing liquids, the mass-rate of flow (m) is obtained from $$m = K_a Q$$

where Q is volumetric (measured) flow rate.

FIG. 3 represents a typical apparatus arrangement for illustrating the calculation of $\phi$. Spin tube 1 is a cylindrical passageway in an element also providing the upper surface 2 of a slot-type jet 4 extending symmetrically 360° about the threadline direction T. An extension 6 of spin tube 1 is a cylindrical passageway in an element also providing the lower surface 8 of jet 4. The angle formed by jet 4 with threadline direct T is $\theta$.

The velocity $V_1$ of overflowing liquid with volume flow rate of $Q_1$ is:

$$V_1 = \frac{Q_1}{A_1} = \frac{4k_b Q_1}{\pi d_1^2}$$

and the velocity $V_2$ of jetted liquid along the threadline direction T is:

$$V_2 = k_b \frac{Q_2}{A_2} \cos\theta$$

In this case, $A_2$ is the area of the curved surface of the frustrum (indicated by dotted lines in FIG. 3) of a right cone which is computed from:

$$A_2 = \pi(r_a + r_b)\sqrt{h^2 + (r_b - r_a)^2}$$

where $r_b$=radius of the base of the frustrum $r_a$=radius of the top of the frustrum=$d_{\frac{1}{2}}$ h=height of the frustrum=$d_2 \sin\theta$.

From purely geometrical considerations, $$r_b = \frac{d_b}{2} = \frac{d_1}{2} + d_2 \cos\theta$$

Thus, $$A_2 = \pi(d_1 + d_2\cos\theta)\sqrt{d_2^2 \sin^2\theta + d_2^2\cos^2\theta}$$

$$= \pi d_2(d_1 + d_2\cos\theta)$$

Further, $V_2 = k_b Q_2 \cos\theta/[\pi d_2(d_1 + d_2\cos\theta)]$

Assembling all the derived portions, $$\phi = \frac{m_2 V_2}{m_1 V_1} = \frac{(k_a Q_2)}{(k_a Q_1)} \cdot \frac{k_b Q_2 \cos\theta}{4k_b Q_1} \cdot \frac{\pi d_1^2}{\pi d_2(d_1 + d_2\cos\theta}$$

which reduces to:

$$\phi = \frac{Q_2^2 \cos\theta}{4 Q_1^2} \times \frac{d_1^2}{d_2(d_1 + d_2\cos\theta)}$$

As long as $d_1$ and $d_2$, and $Q_1$ and $Q_2$, are in the same units, the ratio $\phi$ is independent of the units selected.

RATIO OF MASS-FLOW RATES

This is the ratio of mass-flow rate of total coagulating liquid to mass-flow rate of filaments. The basic unit of liquid flow rate Q herein is in gal./min.

$$Q \times 3899 = \text{mass-flow in gm/min.}$$

For yarn, basic units are speed Y in yd/min and denier D in gm/($9 \times 10^3$ m).

$$YD \times \frac{.9144}{9 \times 10^3} = \text{mass} - \text{flow in gm/min.}$$

The ratio then becomes $$\frac{Q}{YD} \times \frac{3899 \times 9 \times 10^3}{0.9144} = \frac{Q}{YD} \times 3.8376 \times 10^7$$

In these derivatives it is assumed that density of coagulating liquid is about 1.03 g/ml.

TWIST MULTIPLIER

The twist multiplier (TM) correlates twist per unit of length with linear density of the yarn (or cord) being twisted. It is computed from $$TM = (\text{Denier})^{\frac{1}{2}}\,(\text{tpi})/73$$

where tpi=turns per inch, and $$TM=(dtex)^{\frac{1}{2}}(tpc)30.3$$

where tpc=turns per centimeter.

SUPPORTING OBSERVATIONS

It is believed that the use of supplemental jetting of coagulating fluid according to this invention improves the coagulating process. This is supported by two observations. First, the diameter of the yarn bundle within the stream of coagulating liquid exiting the spin tube/jet device is larger by measurement when the jet is operating. Secondly, by measuring the temperature of the exiting stream of coagulating liquid and calculating a heat balance, it has been possible to confirm that more sulfuric acid (exothermic dissolution) is extracted from the yarn when the jet is operating.

For a given spinning system, it would be expected that a definite relationship between tenacity, total flow of coagulating liquid, and $\phi$ should be obtained. To generate such a relationship would require an impractical number of tests. Results obtained, however, are consistent with the hypothesis that a plot of maximum attainable tenacities versus total flow rates of coagulating fluid is a broad peak with high positive slope at low total flow rates and relatively low negative slope beyond the maximum achievable tenacity. Within this broad peak, much narrower peaks for each $\phi$ have a maximum tenacity on the broad peak but sharply negative slopes at flow rates above that producing maximum tenacity. Thus, low $\phi$ values correspond to low total flows, and vice versa, when maximum attainable tenacity is obtained for each given value of $\phi$.

EXAMPLE I

This example illustrates results obtainable using a spin tube with no extension, i.e., with no confinement of the stream of coagulating liquid below the jet. Comparisons were made to results using a previously optimized spin tube having no provision for jetting (identified in Table I by "No Jet"). The no-jet spin tube was 4 in. (10.2 cm) long, had an inside diameter of 0.28 in. (0.71 mm), and was provided with a diameter-reducing deflection ring (referred to herein as a "rim") at the entrance orifice which, in cross-section, was 15 mils (0.38 mm) square (see Lewis U.S. Pat. No. 4,078,034).

Figure 1:
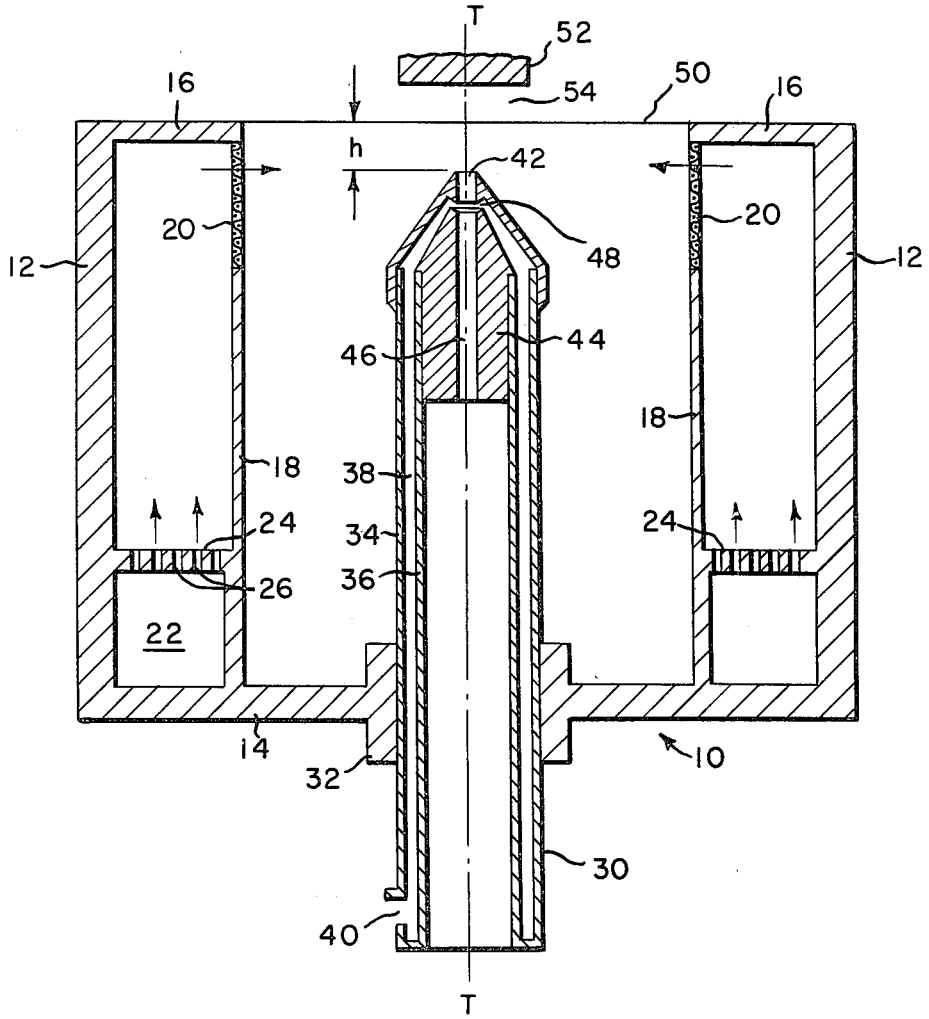
FIG. 1 is a spin tube including a quench jet suitable for carrying out the process of the present invention.

Jet A is a spin tube/jet apparatus as shown in FIG. 1 wherein the spin tube is 0.38 in (0.97 cm) long, has an inside diameter of 0.375 in (0.96 cm) and a 20 mm) square rim. At the exit of the tube a 360° slot-type jet (FIG. 2*a*) 0.5 in (1.27 mm) wide and about 0.1 in (2.54 mm) long with $\theta=45°$ is positioned. Operation of the "no jet" spin tube and Jet A are compared in "Comparison #1" of Table I. The elevation h is 9/16 inch (1.43 cm). Not only does use of Jet A increases tenacity, but it also desirably increases modulus.

Except for the change in yarn speed, Comparison #2 essentially duplicated Comparison #1. Flow rate for the No-Jet case was not recorded.

Comparison #3 is similar to Comparison #1 except that Jet C differs from Jet A in that the spin tube is 3.0 in (7.6 cm) long (8× longer) and a different jet width is employed. Consistent with other results, use of a jet with a long spin tube provides lower improvement in tenacity because the jet is applied 10-1/6 msec. downstream from the entrance of the spin tube.

Series #1 was performed using Jet D which differed from Jet A in that $\theta$ is 30° and a different jet width is used. Series #1 shows that tenacity increases with increasing $\phi$ but that at R less than 80 the improvement is relatively minor.

EXAMPLE II

Jet E is employed in these two series of tests. Jet E differs from Jet A in that $\theta$ is 30° and either a 1 in (2.54 cm) or a 2 in (5.08 cm) extension of the spin tube is used below the jet. The extension diameter is identical to that of the spin tube. The elevation h is 9/16 inch (1.43 cm). Both tenacity and modulus increase with increasing $\phi$ but when $\phi$ exceeds 6, property levels being to drop. Results are shown in Table II.

EXAMPLE III

In this example Jet E of Example II with the 2 in (5.08 cm) extension is used with the jet width adjusted to 20 mils (0.51 mm). Yarn speed is lower at 400 yd/min (366 m/min). Also, linear density of the yarn is increased 3× at a variety of linear density per filament values. In two of the three cases, direct comparisons are made to results obtained using the no-jet assembly of Example I. Even though $\phi$ is undesirably low, tenacities obtained using Jet E are higher; but the extent of improvement appears to decrease with increasing linear density per filament. Results are shown in Table III.

EXAMPLE IV

This example shows that tenacity improvement can be obtained even if $\theta=90°$. In this case, however, the process is very sensitive and quality of the yarn is poor. The jets are similar to Jet A except that Jet H has no spin tube extension below the jet; Jet I has a 1 in (2.54 cm) extension having an inside diameter equal to that of the spin tube. Results are shown in Table III.

EXAMPLE V

In this example, all variables are kept constant except $Q_2$ (and $\phi$). Jet B differs from Jet A of Example I only in that a 2 in (5.08 cm) extension of the spin tube (same diameter) is used. It is observed that in this comparison, tenacity increases with increasing $\phi$ even up to $\phi=18.38$. This high $\phi$, however, requires high flow rates for coagulating liquid thus adding to cost of production and diminishing mechanical quality of the yarn. Results are shown in Table III.

EXAMPLE VI

In this example all variables are kept constant except $Q_2$ (and $\phi$) using Jet G which is similar to Jet A except $\theta=0$ degrees (FIG. 2*e*). Additionally, the spin tube is 0.50 in (1.27 cm) long, and the jet is 0.25 in (0.63 cm) long, and a 2 inch (5.08 cm) long extension is used with an inside diameter of 0.475 in (1.21 cm). Tenacity again increases with increasing $\phi$ but appears to have reached its maximum near $\phi=6$. Results are shown in Table IV.

EXAMPLE VII

In this example a jet (Jet M) similar to the jet of FIG. 2*b* is used, except that instead of multiple rows of circular jets, there are thre slot jets in series (each extending 360 degrees around the spin tube at its level) and $\theta$ is 30° for all three jets. Each jet is about 0.1 in (2.5 mm) long. Width of jet 1 (top) is 6.5 mils (0.17 mm). Shims of 12 and 15 mils (0.30 and 0.38 mm), respectively, are used to establish widths of jets 2 and 3. At $\theta=30°$, these provide jet widths of at least 6 and 7.5 mils (0.15 and 0.19 mm), respectively. The spin tube above jet 1 is 0.375 in (0.95 cm) in diameter and about 0.385 in (0.98 cm) long. Between jets 1 and 2, diameter and length are about 0.43 in (1.09 cm) and 0.34 in (0.86 cm), respectively. Between jets 2 and 3, diameter and length are about 0.46 in (1.17 cm) and 0.35 in (0.89 cm), respectively. Finally, the extension below jet 3 is about 0.51 in (1.30 cm) in diameter and about 1.05 in (2.67 cm) long. Provision is made to operate any combination of the jets during testing, and headings in Table IV indicate which combinations are employed. It is observed that, except for the two cases with $\phi$ of 0.5 or less, very high tenacities are obtained. These two tests also support the general conclusion that results improve as the time before introduction of jetting liquid is decreased.

EXAMPLE VIII

In this example a jet (Jet N) essentially identical to Jet E with the 2 in (5.08 cm) extension is used but in this case the extension is larger in diameter (0.420 in [1.07 cm]). Jet N is used with equipment which has no means for measuring $Q_1$. The elevation (h of FIG. 1) is 0.45 in (1.14 cm). The optimized no-jet assembly of Example I is used for comparison (elevation is 0.70 in or 1.78 cm). From Table V is can be seen that Jet N provides yarn tenacities considerably higher than those obtained using the no-jet assembly at equal yarn speeds.

The yarns of this example were also tested for "heat-aged breaking strength" (HABS) by measuring tenacity after submitting the yarns in relaxed condition to a temperature of 240° C. for 3 hours. Data in Table V confirm that the tenacity improvement of this invention persists through heat-aging.

In a separate test, yarns of this example were twisted to a twist multiplier of 6.5 in one direction and then 3-plied at a twist multiplier of 6.5 in the opposite direction to form 1500-1-3 cords. These cords were dipped in standard RFL latex formulation, dried under tension, and tested for tenacity. Results are listed under "Cord Ten" in Table V and confirm that the tenacity improvement of this invention persists after conversion to tire cords.

EXAMPLE IX

A large number of tests are carried out using Jet N of Example VIII to produce 1500 denier (1670 dtex), 1000 filament yarns. The results of those tests are shown in Table VI. The spinning speed is 750 ypm (686 m./min.). FIG. 4 is a plot of tenacity versus $\phi$ for the 5 sets of data. There is obvious experimental error indicated by the dashed lines of Curves and D. It is clear that tenacity increases rapidly at first with increasing $\phi$ and eventually passes through a maximum. Indications are that, in some cases, useful improvements in tenacity exist to $\phi$ values greater than 10. Such high $\phi$ values, however, also necessitate very high flow rates of coagulating liquid which are not only uneconomical, but also diminish mechanical quality of yarns produced. Generally a $\phi$ of 0.5 is required to confirm substantial improvement in tenacity and beyond a $\phi$ of about 6 other effects reduce the value of any improved tenacity results. It is preferred that $\phi$ be in the range of about 1.5 to about 4.0.

TABLE I

| EXAMPLE I | | | | | | |
|---|---|---|---|---|---|---|
| | Comparison #1 | | Comparison #2 | | Comparison #3 | |
| | Jet A | No Jet | Jet A | No Jet | Jet C | No Jet |
| Yarn Speed (yd/min) | 500 | 500 | 665 | 665 | 500 | 500 |
| (m/min) | 457 | 457 | 608 | 608 | 457 | 457 |
| Yarn Denier | 1500 | 1500 | 1500 | 1500 | 1500 | 1500 |
| (dtex) | 1670 | 1670 | 1670 | 1670 | 1670 | 1670 |
| Denier/filament | 1.50 | 1.50 | 1.50 | 1.50 | 1.50 | 1.50 |
| (dtex/fil) | 1.67 | 1.67 | 1.67 | 1.67 | 1.67 | 1.67 |
| $\eta$inh for yarn | — | — | — | — | — | — |
| Jet width (mils) | 50 | — | 50 | — | 25 | — |
| (mm) | 1.27 | — | 1.27 | — | 0.64 | — |
| $\theta$ | 45 | — | 45 | — | 45 | — |
| $Q_1$ (gal/min) | 3.2 | 3.4 | 1.85 | — | 1.2 | 3.3 |
| (L/min) | 12.1 | 12.9 | 7.00 | — | 4.54 | 12.5 |
| $Q_2$ (gal/min) | 1.6 | — | 1.74 | — | 1.27 | — |
| (L/min) | 6.1 | — | 6.59 | — | 3.79 | — |
| $\phi$ | 0.3 | — | 1.07 | — | 2.84 | — |
| R | 241 | 171 | 135 | — | 124 | 166 |
| Tenacity (g/den.) | 24.0 | 22.9 | 21.8 | 20.4 | 23.6 | 22.9 |
| (dN/tex) | 21.2 | 20.2 | 19.3 | 18.0 | 20.9 | 20.2 |
| Elongation (%) | 3.7 | 4.0 | 3.5 | 3.4 | 4.3 | 4.1 |
| Modulus (g/den.) | 531 | 445 | 544 | 520 | 422 | 441 |
| (dN/tex) | 469 | 393 | 481 | 460 | 373 | 390 |
| Time from entrance of spin tube to jet (milliseconds) | 1.27 | — | 0.95 | — | 10.0 | — |

| Series #1 | | | | | |
|---|---|---|---|---|---|
| Yarn Speed (yd/min) | 750 | 750 | 750 | 750 | 750 |
| (m/min) | 686 | 686 | 686 | 686 | 686 |
| Yarn Denier | 1500 | 1500 | 1500 | 1500 | 1500 |
| (dtex) | 1670 | 1670 | 1670 | 1670 | 1670 |
| Denier/filament | 1.50 | 1.50 | 1.50 | 1.50 | 1.50 |
| (dtex/fil) | 1.67 | 1.67 | 1.67 | 1.67 | 1.67 |
| $\eta$inh for yarn | — | — | — | — | 4.4 |
| Jet width (mils) | 13 | 13 | 13 | 13 | 13 |
| (mm) | 0.33 | 0.33 | 0.33 | 0.33 | 0.33 |
| $\theta$ | 30 | 30 | 30 | 30 | 30 |
| $Q_1$ (gal/min) | 1.53 | 1.53 | 1.53 | 1.53 | 1.53 |
| (L/min) | 5.79 | 5.79 | 5.79 | 5.79 | 5.79 |

TABLE I-continued

| EXAMPLE I | | | | | |
|---|---|---|---|---|---|
| $Q_2$ (gal/min) | 0 | 0.56 | 0.80 | 1.27 | 2.21 |
| (L/min) | 0 | 2.12 | 3.03 | 4.81 | 8.37 |
| $\phi$ | 0 | 0.81 | 1.66 | 4.18 | 12.65 |
| R | 51 | 70 | 78 | 94 | 125 |
| Tenacity (g/den.) | 18.1 | 18.8 | 18.7 | 19.3 | 19.4 |
| (dN/tex) | 16.0 | 16.6 | 16.5 | 17.1 | 17.1 |
| Elongation (%) | 4.4 | 4.2 | 4.2 | 4.1 | 4.0 |
| Modulus (g/den.) | 382 | 397 | 392 | 404 | 412 |
| (dN/tex) | 338 | 351 | 346 | 357 | 364 |
| Time from entrance of spin tube to jet (milliseconds) | 0.84 | 0.84 | 0.84 | 0.84 | 0.84 |

TABLE II

| EXAMPLE II | JET E 1 inch (2.54 cm) extension | | | |
|---|---|---|---|---|
| Yarn Speed | | | | |
| (yd/min) | 750 | 750 | 750 | 750 |
| (m/min) | 686 | 686 | 686 | 686 |
| Yarn Denier | 1500 | 1500 | 1500 | 1500 |
| (dtex) | 1670 | 1670 | 1670 | 1670 |
| Denier/filament | 1.50 | 1.50 | 1.50 | 1.50 |
| (dtex/fil) | 1.67 | 1.67 | 1.67 | 1.67 |
| $\eta$inh for yarn | 5.0 | 5.0 | 5.0 | 5.0 |
| Jet width (mils) | 13 | 13 | 13 | 13 |
| (mm) | 0.33 | 0.33 | 0.33 | 0.33 |
| $\theta$ | 30 | 30 | 30 | 30 |
| $Q_1$ (gal/min) | 1.88 | 1.88 | 1.88 | 1.88 |
| (L/min) | 7.12 | 7.12 | 7.12 | 7.12 |
| $Q_2$ (gal/min) | 0 | 0.80 | 1.53 | 1.98 |
| (L/min) | 0 | 3.03 | 5.79 | 7.49 |
| $\phi$ | 0 | 1.10 | 4.02 | 6.73 |
| R | 63 | 90 | 114 | 129 |
| Tenacity (g/den.) | 19.3 | 20.7 | 22.9 | 21.7 |
| (dN/tex) | 17.1 | 18.3 | 20.2 | 19.2 |
| Elongation (%) | 4.1 | 4.1 | 4.2 | 4.2 |
| Modulus (g/den.) | 377 | 389 | 412 | 402 |
| (dN/tex) | 333 | 344 | 364 | 355 |
| Time from entrance of spin tube to jet (milliseconds) | 0.84 | 0.84 | 0.84 | 0.84 |

TABLE II-continued

| EXAMPLE II | JET E 2 inch (5.08 cm) extension | | | |
|---|---|---|---|---|
| Yarn Speed | | | | |
| (yd/min) | 750 | 750 | 750 | 750 |
| (m/min) | 686 | 686 | 686 | 686 |
| Yarn Denier | 1500 | 1500 | 1500 | 1500 |
| (dtex) | 1670 | 1670 | 1670 | 1670 |
| Denier/filament | 1.50 | 1.50 | 1.50 | 1.50 |
| (dtex/fil) | 1.67 | 1.67 | 1.67 | 1.67 |
| $\eta$inh for yarn | 5.0 | 5.0 | 5.0 | 5.0 |
| Jet width (mils) | 13 | 13 | 13 | 13 |
| (mm) | 0.33 | 0.33 | 0.33 | 0.33 |
| $\theta$ | 30 | 30 | 30 | 30 |
| $Q_1$ (gal/min) | 2.38 | 2.38 | 2.38 | 2.38 |
| (L/min) | 9.01 | 9.01 | 9.01 | 9.01 |
| $Q_2$ (gal/min) | 0 | 0.80 | 1.27 | 2.21 |
| (L/min | 0 | 3.03 | 4.81 | 8.37 |
| $\phi$ | 0 | 0.69 | 1.73 | 5.23 |
| R | 80 | 106 | 122 | 154 |
| Tenacity (g/den.) | 19.0 | 19.9 | 21.5 | 21.9 |
| (dN/tex) | 16.8 | 17.6 | 19.0 | 19.4 |
| Elongation (%) | 3.9 | 3.9 | 4.1 | 4.1 |
| Modulus (g/den.) | 391 | 406 | 397 | 398 |
| (dN/tex) | 346 | 359 | 351 | 352 |
| Time from entrance of spin tube to jet (milliseconds) | 0.84 | 0.84 | 0.84 | 0.84 |

TABLE III

| EXAMPLE III | Comparison #1 | | Comparison #2 | | |
|---|---|---|---|---|---|
| | Jet E | No Jet | Jet E | No Jet | Jet E |
| Yarn Speed (yd/min) | 400 | 400 | 400 | 400 | 400 |
| (m/min) | 366 | 366 | 366 | 366 | 366 |
| Yarn Denier | 3000 | 3000 | 3000 | 3000 | 3000 |
| (dtex) | 3330 | 3330 | 3330 | 3330 | 3330 |
| Denier/filament | 1.5 | 1.5 | 2.25 | 2.25 | 3.0 |
| (dtex/fil) | 1.67 | 1.67 | 1.99 | 1.99 | 2.65 |
| $\eta$inh for yarn | 5.3 | 5.3 | 5.4 | 5.3 | — |
| Jet width (mils) | 20 | — | 20 | — | 20 |
| (mm) | 0.51 | — | 0.51 | — | 0.51 |
| $\theta$ | 30 | — | 30 | — | 30 |
| $Q_1$ (gal/min) | 4.4 | 4.45 | 4.25 | 5.0 | 4.25 |
| (L/min) | 16.7 | 16.8 | 16.1 | 18.9 | 6.1 |
| $Q_2$ (gal/min) | 1.0 | — | 1.0 | — | 1.0 |
| (L/min) | 3.8 | — | 3.8 | — | 3.8 |
| $\phi$ | 0.20 | — | 0.22 | — | 0.22 |
| R | 169 | 140 | 165 | 157 | 165 |
| Tenacity (g/den.) | 22.3 | 20.9 | 22.4 | 21.3 | 21.8 |
| (dN/tex) | 19.7 | 18.5 | 19.8 | 18.8 | 19.3 |
| Elongation (%) | 4.3 | 5.1 | 4.2 | 4.1 | 4.7 |
| Modulus (g/den.) | 467 | 384 | 479 | 454 | 380 |
| (dN/tex) | 413 | 339 | 423 | 401 | 336 |
| Time from entrance of spin tube to jet (milliseconds) | 1.58 | — | 1.58 | — | 1.58 |

| EXAMPLE IV | | |
|---|---|---|
| | Jet H | Jet I |

TABLE III-continued

| | | |
|---|---|---|
| Yarn Speed (yd/min) | 750 | 750 |
| (m/min) | 686 | 686 |
| Yarn Denier | 1500 | 1500 |
| (dtex) | 1670 | 1670 |
| Denier/filament | 1.5 | 1.5 |
| (dtex/fil) | 1.67 | 1.67 |
| ηinh for yarn | — | 5.05 |
| Jet width (mils) | 13 | 13 |
| (mm) | 0.33 | 0.33 |
| θ | 0 | 0 |
| $Q_1$ (gal/min) | 1.6 | 2.0 |
| (L/min) | 6.1 | 7.6 |
| $Q_2$ (gal/min) | 1.04 | 0.56 |
| (L/min) | 3.9 | 2.1 |
| θ- | — | — |
| R | 88 | 86 |
| Tenacity (g/den.) | 22.3 | 20.2 |
| (dN/tex) | 19.7 | 17.9 |
| Elongation (%) | 4.4 | 4.1 |
| Modulus (g/den.) | 409 | 454 |
| (dN/tex) | 361 | 401 |
| Time from entrance of spin tube to jet (milliseconds) | 0.84 | 0.84 |

EXAMPLE V

| | SERIES - JET B | | | | |
|---|---|---|---|---|---|
| | 1 | 2 | 3 | 4 | 5 |
| Yarn Speed | | | | | |
| (yd/min) | 750 | 750 | 750 | 750 | 750 |
| (m/min) | 686 | 686 | 686 | 686 | 686 |
| Yarn Denier | 1500 | 1500 | 1500 | 1500 | 1500 |
| (dtex) | 1670 | 1670 | 1670 | 1670 | 1670 |
| Denier/filament | 1.5 | 1.5 | 1.5 | 1.5 | 1.5 |
| (dtex/fil) | 1.67 | 1.67 | 1.67 | 1.67 | 1.67 |
| ηinh for yarn | 4.6 | 4.6 | 4.6 | 4.6 | 4.6 |
| Jet width (mils) | 13 | 13 | 13 | 13 | 13 |
| (mm) | 0.33 | 0.33 | 0.33 | 0.33 | 0.33 |
| θ | 45 | 45 | 45 | 45 | 45 |
| $Q_1$ (gal/min) | 1.15 | 1.15 | 1.15 | 1.15 | 1.15 |
| (L/min) | 4.35 | 4.35 | 4.35 | 4.35 | 4.35 |
| $Q_2$ (gal/min) | 0 | 0.56 | 0.80 | 1.27 | 2.21 |
| (L/min) | 0 | 2.12 | 3.03 | 4.80 | 8.40 |
| ϕ | 0 | 1.67 | 2.41 | 6.07 | 18.38 |
| R | 38 | 57 | 65 | 81 | 112 |
| Tenacity (g/den.) | 16.7 | 17.6 | 18.3 | 19.3 | 21.2 |
| (dN/tex) | 14.7 | 15.6 | 16.2 | 17.1 | 18.7 |
| Elongation (%) | 4.4 | 4.4 | 4.5 | 4.5 | 4.7 |
| Modulus (g/den.) | 340 | 337 | 353 | 369 | 373 |
| (dN/tex) | 300 | 298 | 312 | 326 | 330 |
| Time from entrance of spin tube to jet (milliseconds) | 0.84 | 0.84 | 0.84 | 0.84 | 0.84 |

TABLE IV

EXAMPLE VI

| | SERIES - JET G | | | |
|---|---|---|---|---|
| | 1 | 2 | 3 | 4 |
| Yarn Speed | | | | |
| (yd/min) | 750 | 750 | 750 | 750 |
| (m/min) | 686 | 686 | 686 | 686 |
| Yarn Denier | 1500 | 1500 | 1500 | 1500 |
| (dtex) | 1670 | 1670 | 1670 | 1670 |
| Denier/filament | 1.5 | 1.5 | 1.5 | 1.5 |
| (dtex/fil) | 1.67 | 1.67 | 1.67 | 1.67 |
| ηinh for yarn | 5.0 | 5.0 | 5.0 | 5.0 |
| Jet width (mils) | 20 | 20 | 20 | 20 |
| (mm) | 0.51 | 0.51 | 0.51 | 0.51 |
| θ | 0 | 0 | 0 | 0 |
| $Q_1$ (gal/min) | 1.78 | 1.78 | 1.78 | 1.78 |
| (L/min) | 6.74 | 6.74 | 6.74 | 6.74 |
| $Q_2$ (gal/min) | 0 | 0.80 | 1.52 | 2.21 |
| (L/min) | 0 | 3.01 | 5.75 | 8.37 |
| ϕ | 0 | 0.90 | 3.25 | 6.86 |
| R | 60 | 86 | 110 | 133 |
| Tenacity (g/den.) | 19.6 | 20.3 | 20.6 | 20.3 |
| (dN/tex) | 17.3 | 17.9 | 18.2 | 17.9 |
| Elongation (%) | 4.0 | 4.0 | 3.9 | 3.8 |

TABLE IV-continued

| | | | | |
|---|---|---|---|---|
| Modulus (g/den.) | 378 | 401 | 417 | 423 |
| (dN/tex) | 334 | 354 | 369 | 374 |
| Time from entrance of spin tube to jet (milliseconds) | 0.84 | 0.84 | 0.84 | 0.84 |

EXAMPLE VII

| | JET - M | | | |
|---|---|---|---|---|
| | Jet 1 | Jets 1,2,3 | Jet 1 | Jets 1,2,3 |
| Yarn Speed | | | | |
| (yd/min) | 665 | 665 | 750 | 750 |
| (m/min) | 608 | 608 | 686 | 686 |
| Yarn Denier | 1500 | 1500 | 1500 | 1500 |
| (dtex) | 1670 | 1670 | 1670 | 1670 |
| Denier/filament | 1.5 | 1.5 | 1.5 | 1.5 |
| (dtex/fil) | 1.67 | 1.67 | 1.67 | 1.67 |
| ηinh for yarn | — | — | — | — |
| Jet width (mils) | See text | | | |
| (mm) | | | | |
| θ | 30 | 30 | 30 | 30 |
| $Q_1$ (gal/min) | 3.3 | 3.0 | 3.1 | 3.1 |
| (L/min) | 12.5 | 11.4 | 11.7 | 11.7 |
| $Q_2$ (gal/min) | 1.55 | 1.70 | 1.50 | 1.95 |

TABLE IV-continued

| | | | | |
|---|---|---|---|---|
| (L/min) | 5.9 | 6.4 | 5.7 | 7.4 |
| $\phi$ | 2.39 | 3.5 | 2.53 | 4.28 |
| R | 183 | 177 | 154 | 169 |
| Tenacity (g/den.) | 24.3 | 24.4 | 23.7 | 24.5 |
| (dN/tex) | 21.5 | 21.6 | 20.9 | 21.7 |
| Elongation (%) | — | — | — | — |
| Modulus (g/den.) | — | — | — | — |
| (dN/tex) | — | — | — | — |
| Time from entrance of spin tube to jet (milliseconds) | 0.96 | 0.96 | 0.86 | 0.86 |

| | JET - M | | |
|---|---|---|---|
| | Jets 1,2,3 | Jet 1,2,3 | Jets 2,3 |
| Yarn Speed | | | |
| (yd/min) | 750 | 750 | 750 |
| (m/min) | 686 | 686 | 686 |
| Yarn Denier | 1500 | 1500 | 1500 |
| (dtex) | 1670 | 1670 | 1670 |
| Denier/filament | 1.5 | 1.5 | 1.5 |
| (dtex/fil) | 1.67 | 1.67 | 1.67 |
| $\eta$inh for yarn | — | — | — |
| Jet width (mils) | | See text | |
| (mm) | | | |
| $\theta$ | 30 | 30 | 30 |
| $Q_1$ (gal/min) | 2.9 | 2.75 | 3.1 |
| (L/min | 11.0 | 10.4 | 11.7 |
| $Q_2$ (gal/min) | 1.55 | 0.60 | 0.60 |
| (L/min | 5.9 | 2.3 | 2.3 |
| $\phi$ | 3.1 | 0.5 | 0.4 |
| R | 149 | 112 | 124 |
| Tenacity (g/den.) | 23.9 | 22.4 | 21.6 |
| (dN/tex) | 21.1 | 19.8 | 19.1 |
| Elongation (%) | — | — | — |
| Modulus (g/den.) | — | — | — |
| (dN/tex) | — | — | — |
| Time from entrance of spin tube to jet (milliseconds) | 0.86 | 0.86 | 1.61 |

TABLE V

| | EXAMPLE VIII | | | |
|---|---|---|---|---|
| | Jet N | No Jet | Jet N | No Jet |
| Yarn Speed | | | | |
| (yd/min) | 665 | 665 | 750 | 750 |
| (m/min) | 608 | 608 | 686 | 686 |
| Yarn Denier | 1500 | 1500 | 1500 | 1500 |
| (dtex) | 1670 | 1670 | 1670 | 1670 |
| Denier/filament | 1.5 | 1.5 | 1.5 | 1.5 |
| (dtex/fil) | 1.67 | 1.67 | 1.67 | 1.67 |
| $\eta$inh for yarn | — | — | — | — |
| Jet width (mils) | 12 | — | 12 | — |
| (mm) | 0.30 | — | 0.30 | — |
| $\theta$ | 30 | — | 30 | — |
| $Q_1$ (gal/min) | See text | | | |
| (L/min) | | | | |
| $Q_2$ (gal/min) | 1.25 | — | 1.50 | — |
| (L/min) | 4.73 | — | 5.68 | — |
| $\phi$ | ? | — | ? | — |
| R | ? | ? | ? | ? |
| Tenacity (g/den.) | 24.0 | 22.5 | 23.5 | 20.9 |
| (dN/tex) | 21.2 | 19.9 | 20.8 | 18.5 |
| Elongation (%) | 3.8 | 3.3 | 3.9 | 3.3 |
| Modulus (g/den.) | 523 | 589 | 519 | 556 |
| (dN/tex) | 462 | 521 | 459 | 491 |
| HABS (1b) | 59.2 | 55.0 | 54.6 | 48.1 |
| (kg) | 26.9 | 24.9 | 24.8 | 21.8 |
| Cord Ten. (g/den) | 18.5 | 17.7 | 18.2 | 16.4 |
| dN/tex | 16.4 | 15.6 | 16.1 | 14.5 |
| Time from entrance of spin tube to jet (milliseconds) | 0.95 | — | 0.84 | — |
| Yarn Speed | | | | |
| (yd/min) | 800 | 800 | 850 | 850 |
| (m/min) | 732 | 732 | 777 | 777 |
| Yarn Denier | 1500 | 1500 | 1500 | 1500 |
| (dtex) | 1670 | 1670 | 1670 | 1670 |
| Denier/filament | 1.5 | 1.5 | 1.5 | 1.5 |

TABLE V-continued

| | EXAMPLE VIII | | | |
|---|---|---|---|---|
| | Jet N | No Jet | Jet N | No Jet |
| (dtex/fil) | 1.67 | 1.67 | 1.67 | 1.67 |
| $\eta$inh for yarn | — | — | — | — |
| Jet width (mils) | 12 | — | 12 | — |
| (mm) | 0.30 | — | 0.30 | — |
| $\theta$ | 30 | — | 30 | — |
| $Q_1$ (gal/min) | See text | | | |
| (L/min) | | | | |
| $Q_2$ (gal/min) | 1.60 | — | 1.70 | — |
| (L/min) | 6.06 | — | 6.44 | — |
| $\phi$ | ? | — | ? | — |
| R | ? | ? | ? | ? |
| Tenacity (g/den.) | 23.3 | 21.4 | 23.1 | 20.6 |
| (dN/tex) | 20.6 | 18.9 | 20.4 | 18.2 |
| Elongation (%) | 3.8 | 3.3 | 3.7 | 3.2 |
| Modulus (g/den.) | 523 | 578 | 543 | 573 |
| (dN/tex) | 462 | 511 | 480 | 506 |
| HABS (lb) | 55.0 | 49.8 | 51.5 | 50.6 |
| (kg) | 24.9 | 22.6 | 23.4 | 23.0 |
| Cord Ten. (g/den) | 18.0 | 16.7 | 17.9 | 16.3 |
| dN/tex | 15.9 | 14.8 | 15.8 | 14.4 |
| Time from entrance of spin tube to jet (milliseconds) | 0.79 | — | 0.74 | — |

TABLE VI

| EXAMPLE IX | | | | |
|---|---|---|---|---|
| | Jet Gap mils (mm) | $Q_1$ gal/min (L/min) | $Q_2$ gal/min (L/min) | $\phi$ |
| Curve A (x) | 0 | 3.15(11.9) | 0 | 0 |
| | 3.0(0.076) | 3.10(11.7) | 1.50(5.7) | 6.26 |
| | 4.0(0.102) | 3.10(11.7) | 1.50(5.7) | 4.69 |
| | 6.0(0.152) | 3.10(11,7) | 1.50(5.7) | 3.11 |
| | 8.0(0.203) | 3.10(11.7) | 1.50(5.7) | 2.32 |
| | 10.0(0.254) | 3.10(11.7) | 1.50(5.7) | 1.85 |
| | 15.0(0.381) | 3.10(11.7) | 1.50(5.7) | 1.22 |
| | 20.0(0.508) | 3.10(11.7) | 1.50(5.7) | 0.91 |
| | 30.0(0.762) | 3.10(11.7) | 1.50(5.7) | 0.59 |
| | 40.0(1.016) | 3.10(11.7) | 1.50(5.7) | 0.43 |
| | 60.0(1.524) | 3.10(11.7) | 1.50(5.7) | 0.28 |
| Curve B (⊙) | 12.0(0.305) | 2.85(10.8) | 0 | 0 |
| | 12.0(0.305) | 2.90(11.0) | 0.30(1.1) | 0.07 |
| | 12.0(0.305) | 2.85(10.8) | 0.50(1.9) | 0.20 |
| | 12.0(0.305) | 2.90(11.0) | 0.70(2.6) | 0.38 |
| | 12.0(0.305) | 2.85(10.8) | 1.10(4.2) | 0.65 |
| | 12.0(0.305) | 2.85(10.8) | 1.50(5.7) | 0.98 |
| | 12.0(0.305) | 2.85(10.8) | 1.10(4.2) | 1.82 |
| | 12.0(0.305) | 2.90(11.0) | 1.90(7.2) | 2.81 |
| | 12.0(0.305) | 2.90(11.0) | 2.70(10.2) | 5.68 |
| | 12.0(0.305) | 2.85(10.8) | 3.10(11.7) | 7.76 |
| | 12.0(0.305) | 2.85(10.8) | 3.50(13.2) | 9.89 |
| Curve C (●) | 12.0(0.305) | 3.08(11.7) | 0.1(0.38) | 0.007 |
| | 12.0(0.305) | 3.08(11.7) | 0.2(0.76) | 0.03 |
| | 12.0(0.305) | 3.08(11.7) | 0.3(1.14) | 0.06 |
| | 12.0(0.305) | 2.57(9.7) | 0.4(1.5) | 0.16 |
| | 12.0(0.305) | 2.48(9.4) | 0.5(1.9) | 0.27 |
| | 12.0(0.305) | 2.48(9.4) | 1.5(5.7) | 2.40 |
| Curve D (▲) | 7.0(0.178) | 3.08(11.7) | 0 | 0 |
| | 7.0(0.178) | 3.08(11.7) | 1.5(5.7) | 2.70 |
| | 7.0(0.178) | 3.03(11.5) | 2.0(7.6) | 4.95 |
| | 7.0(0.178) | 3.03(11.5) | 2.5(9.5) | 7.74 |
| Curve E (⊡) | 7.0(0.178) | 3.08(11.7) | 0.25(0.95) | 0.07 |
| | 7.0(0.178) | 3.08(11.7) | 0.75(2.8) | 0.67 |
| | 7.0(0.178) | 3.08(11.7) | 1.00(3.8) | 1.20 |
| | 7.0(0.178) | 2.90(11.0) | 1.50(5.7) | 3.04 |
| | 7.0(0.178) | 2.90(11.0) | 2.00(7.6) | 5.41 |
| | 7.0(0.178) | 3.08(11.7) | 2.50(9.5 | 7.49 |

| | Tenacity g/Den (dN/tex) | Yarn Tension g | Mass Ratio liq./yarn |
|---|---|---|---|
| Curve A (x) | 21.2(18.8) | 570 | 105 |
| | 2.3(18.8) | 490 | 154 |
| | 23.0(20.3) | 490 | 154 |
| | 22.8(20.2) | 500 | 154 |
| | 23.1(20.4) | 530 | 154 |

TABLE VI-continued

| EXAMPLE IX | | | |
|---|---|---|---|
| | 22.8(20.2) | 510 | 154 |
| | 23.1(20.4) | 660 | 154 |
| | 22.7(20.1) | 680 | 154 |
| | 23.0(20.3) | 690 | 154 |
| | 23.3(20.6) | 700 | 154 |
| | 22.4(19.8) | 730 | 154 |
| Curve B (10) | 20.9(18.5) | 500 | 95 |
| | 21.8(19.3) | 600 | 109 |
| | 22.2(19.6) | 610 | 112 |
| | 22.0(19.4) | 670 | 120 |
| | 22.2(19.6) | 590 | 125 |
| | 21.9(19.4) | 650 | 132 |
| | 22.3(19.7) | 600 | 146 |
| | 22.0(19.4) | 620 | 161 |
| | 22.5(19.9) | 590 | 187 |
| | 22.6(20.0) | 510 | 199 |
| | 22.3(19.7) | 490 | 212 |
| Curve C(500) | 21.4(18.9) | 700 | 103 |
| | 20.7(18.3) | 700 | 106 |
| | 21.3(18.8) | 500 | 110 |
| | 22.1(19.5) | 490 | 96 |
| | 21.5(19.0) | 475 | 97 |
| | 22.2(19.6) | 500 | 129 |
| Curve D (10) | 21.0(18.5) | 500 | 103 |
| | 22.0(19.4) | 500 | 153 |
| | 22.7(20.1) | 550 | 168 |
| | 21.3(18.8) | 400 | 185 |
| Curve E (10) | 20.2(17.9) | 600 | 111 |
| | 20.7(18.3) | 550 | 128 |
| | 21.1(18.6) | 550 | 136 |
| | 21.6(19.1) | 440 | 147 |
| | 21.8(19.3) | 430 | 164 |
| | 21.7(19.2) | 400 | 187 |

I claim:

1. In a process for preparing high strength, high modulus aromatic polyamide filaments by extruding an acid solution containing at least 30 g. per 100 ml. acid of an aromatic polyamide having an inherent viscosity of at least 4 and chain extending bonds which are either coaxial or parallel and oppositely directed through a layer of inert noncoagulating fluid into a coagulating bath and then through a spin tube along with overflowing coagulating liquid, the improvement comprising jetting additional coagulating liquid symmetrically about the filaments in a downward direction forming an angle $\theta$ of 0° to 85° with respect to the filaments within 2.0 milliseconds from the time the filaments enter the spin tube, the flow rates of both the jetted and overflowing coagulating liquid being maintained at a constant rate such that their momentum ratio $\phi$ is from 0.5 to 6.0 and the mass flow rate of total coagulating liquid is from 70 to 200 times the mass flow rate of the filaments.

2. Process of claim 1 wherein the filaments and coagulating liquid are confined below the point where the jetting liquid is introduced by an extension of the spin tube having the same cross-sectional shape as the spin tube with a minor cross-sectional dimension of from 0.5 to 1.5 times that of the spin tube and a length/minor dimension ratio of 0.5 to 10.

3. Process of claim 1 wherein the jetted liquid is applied within 1.0 millisecond from the time the filaments enter the spin tube.

4. Process of claim 1 wherein the filaments are wound up at a speed of at least 500 yards/min.

5. Process of claim 1 wherein the filaments are wound up at a speed of at least 650 yards/min.

6. Process of claim 1 wherein the filaments are wound up at a speed of at least 750 yards/min.

7. Process of claim 1 wherein $\phi$=30° to 45°.

8. Process of claim 1 wherein $\phi$ is 1.5 to 4 and the mass flow rate of the total coagulating liquid is 80 to 120 times the mass flow rate of the filaments.

* * * * *